US005734999A

United States Patent [19]

Nicholas

[11] Patent Number: 5,734,999

[45] Date of Patent: Apr. 7, 1998

[54] SAFETY DEVICE FOR SWIMMING POOLS

[75] Inventor: John J. Nicholas, 127 N. Hidden Canyon Dr., Orange, Calif. 92869

[73] Assignee: John J. Nicholas, Orange, Calif.

[21] Appl. No.: 788,649

[22] Filed: Jan. 24, 1997

[51] Int. Cl.[6] ..... E04H 4/00

[52] U.S. Cl. ..... 4/507; 4/504; 4/496

[58] Field of Search ..... 4/507, 504, 488, 4/490, 496, 509, 292

[56] References Cited

U.S. PATENT DOCUMENTS

| | | |
|---|---|---|
| D. 254,928 | 5/1980 | Mathis . |
| D. 256,948 | 9/1980 | Boersma . |
| D. 290,167 | 6/1987 | Jacuzzi . |
| D. 299,522 | 1/1989 | Chalberg . |
| D. 319,295 | 8/1991 | Ohaus . |
| D. 333,342 | 2/1993 | Newhard . |
| D. 341,413 | 11/1993 | Nichols . |
| D. 343,228 | 1/1994 | Colin . |
| 3,378,858 | 4/1968 | Jacuzzi . |
| 3,940,807 | 3/1976 | Baker et al. . |
| 4,134,162 | 1/1979 | Sharland et al. . |
| 4,170,047 | 10/1979 | Corsette et al. . |
| 4,658,449 | 4/1987 | Martin . |
| 5,341,523 | 8/1994 | Barnes . |

FOREIGN PATENT DOCUMENTS

| | | | |
|---|---|---|---|
| 4010862 C | 4/1991 | Germany | 4/504 |

*Primary Examiner*—David J. Walczak

*Attorney, Agent, or Firm*—Knobbe, Martens, Olson & Bear,LLP

[57] ABSTRACT

A safety device comprising a floor drain grate includes at least two separate regions, and preferably three, with openings through which water can flow into a pool drain. The regions are preferably spaced to either side of the pool drain, by a distance which effectively prevents a swimmer from blocking all the openings at once and becoming stuck to the grate by suction. The floor drain grate may be provided as a retrofit to replace an existing drain grate of a pool.

11 Claims, 1 Drawing Sheet

SAFETY DEVICE FOR SWIMMING POOLS

BACKGROUND OF THE INVENTION

The present invention relates generally to the field of spas and swimming pools, and, in particular, to a safety device for covering a floor drain of a swimming pool or spa.

A conventional floor drain of a swimming pool or spa has a flushmounted or slightly raised grate located at the inlet to the drain pipe. A recirculating pump causes the water in the pool to flow through the grate, the drain pipe and a filtration system before returning the water to the pool. The grate prevents debris, such as leaves, from passing through the drain line.

Swimmers may obstruct the water flow through the grate. The relatively small size of the grate allows a substantial portion of its entire surface to be covered by a swimmer's foot or hand, for example. The swimmer may become "stuck" to the grate by the difference in pressure caused by the suction of the pump on the drain inlet, thereby creating a safety hazard.

Accumulation of debris over the grate can also present problems. The debris restricts recirculation of the water and produces an extra load on the pump which can degrade the pump's performance and shorten its life.

SUMMARY OF THE INVENTION

The safety device of the present invention overcomes the aforenoted disadvantages by providing at least two regions, and preferably more, on the device through which water may flow into the floor drain of a swimming pool or spa. At least two of these regions are sufficiently spaced such that a swimmer's body is unlikely to obstruct flow through all of the regions simultaneously. Thus, one of the regions will remain unobstructed such that water can flow into the drain and the swimmer cannot become "stuck" to the drain.

In a preferred embodiment, the safety device comprises a flow passage structure which overlies the pool drain. This structure has first and second channel portions which extend outwardly from the drain along the pool floor in opposite directions. A central portion which connects the first and second channel portions is attached over the drain. The first and second channel portions are elongate and the central portion is substantially circular. Each portion has at least a top wall and side walls. Each top wall has a plurality of apertures, with the apertures on the top walls of the first and second portions located distal to the drain. The sides of each portion extend downwardly to the pool floor, except at the ends, which are open and form distal openings or apertures. Each channel portion has additional distal openings or apertures in the top wall, spaced distal to the drain for allowing inflow of water to the drain. The distal apertures of the first portion are preferably spaced from the distal apertures of the second portion by at least about a foot and one half, and preferably at least two feet, to ensure that a swimmer's body does not block all of the openings at the same time.

Although, in the preferred embodiment the first and second channel portions are three-sided, forming an inverted U-shape, they may alternatively have bottom walls which contact and overlie the pool floor. The ends of the first and second channel portions may be closed, slotted, or left open. Additional slots or openings may be provided on the side walls of the channel portions, and on the top wall of the central portion. The central and channel portions may be integrally formed from plastic or the like, or they may be separately formed and bonded together using an appropriate adhesive.

While the present invention is described herein with reference to the floor drain of a swimming pool, it is understood that the present invention has application in the drain of a spa or hot tub. The device of the present invention may be provided as a retrofit to replace an existing pool or spa drain grate.

Further advantages and applications will become apparent to those skilled in the art from the following detailed description of the preferred embodiments and the drawings referenced herein, the invention not being limited to any particular embodiment.

DETAILED DESCRIPTION OF THE PREFERRED EMBODIMENT

Figure 1:
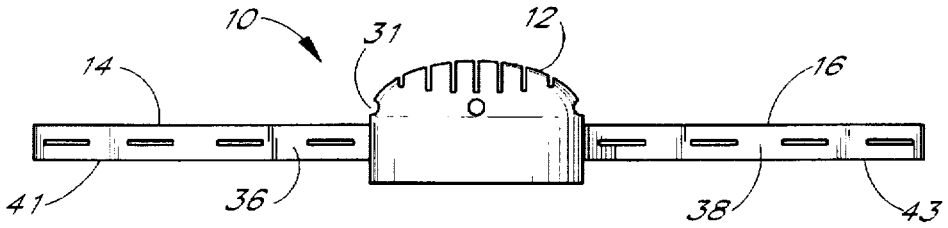
FIG. 1 is an elevation view of a preferred embodiment of a safety device of the present invention.

A preferred embodiment of a safety device 10 illustrated in FIGS. 1–4 comprises a flow passage structure having a central portion 12 from which a pair of channel portions 14, 16 extend in opposite directions parallel to the floor 18 of a pool or spa 20. Openings 22, 24 are provided distally at the ends of the members 14, 16. The central portion 12 has openings 26.

Figure 4:
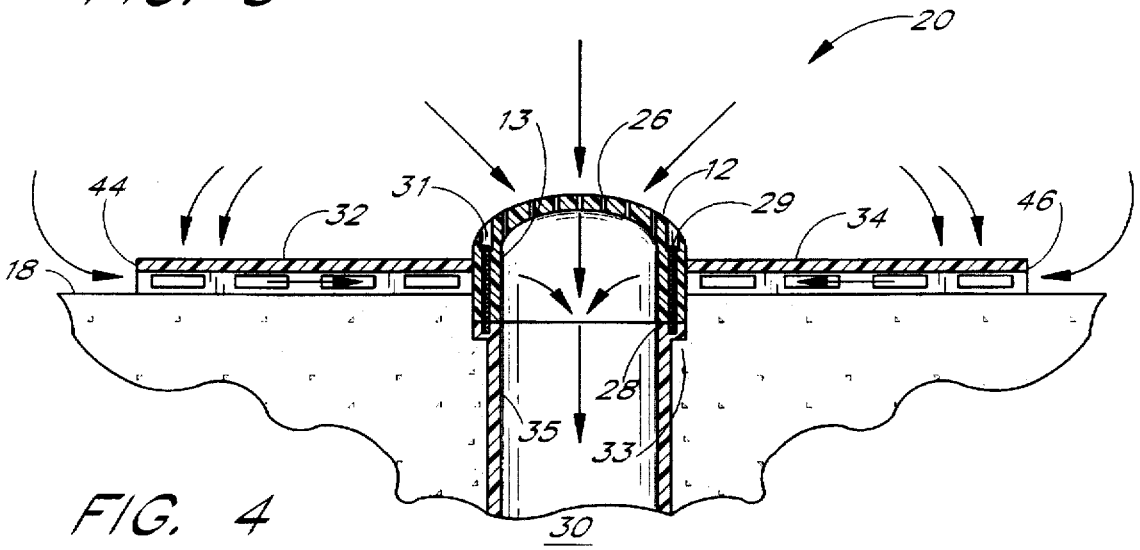
FIG. 4 is a schematic cross-section of the safety device of FIG. 1 as installed over a floor drain of a swimming pool or spa.

Referring to FIG. 4, the central portion 12 is attached at the drain inlet 28 using screws 29 received through holes 31 that extend through thick walls 13 of the central portion 12. The screws 29 are of sufficient length to threadably engage tapped holes in a flange 33 of the drain pipe 35. Preferably, at least four screw holes are provided on the central portion 12, although, any number of holes may be used as long as the device 10 is securely attached over the drain 30. Alternatively, other methods known to those skilled in the art may be used to attach the present device to the floor drain 30.

A plastic, such as PVC, is preferably used to form the central portion 12 and channel portions 14, 16. The central portion 12 is sized to accommodate from a 6 to 10 inch diameter drain and may be integrally formed with the channel portions or attached therewith using adhesive or screws or the like. The members 14, 16 may be removably attached at the drain for access for maintenance or repair.

Figure 2:
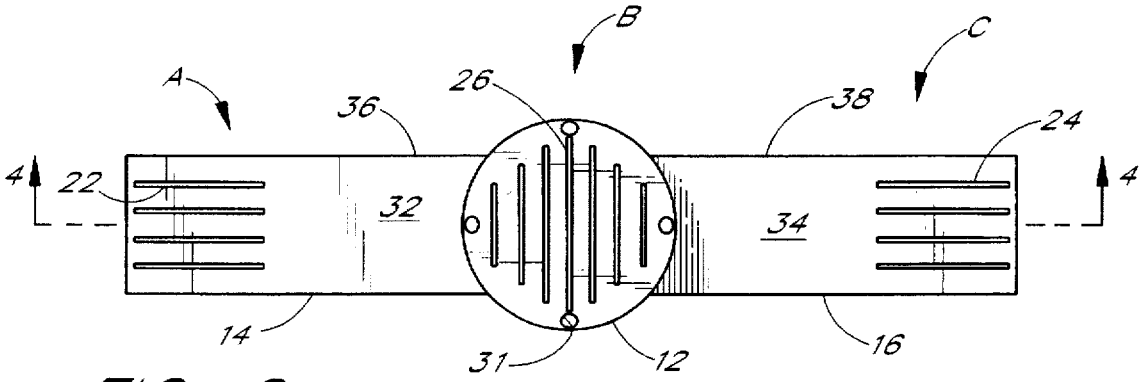
FIG. 2 is a plan view of the safety device of FIG. 1.
Figure 3:
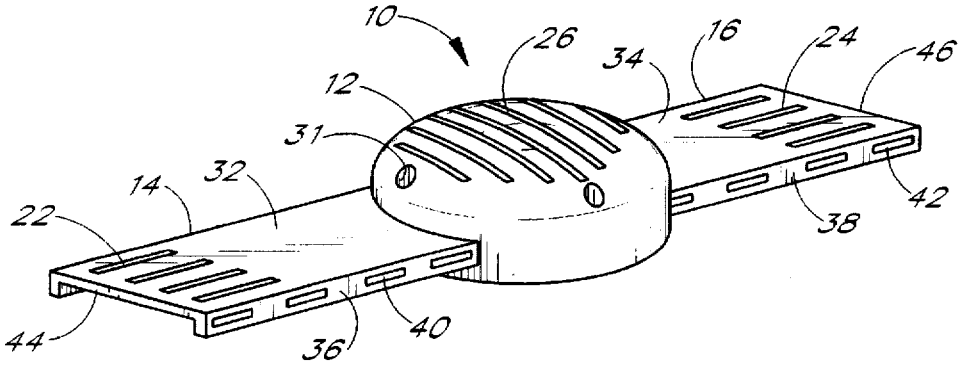
FIG. 3 is a perspective view of the safety device of FIG. 1.

Three primary regions A, B, C for drain inflow, as shown in FIG. 2, are spaced apart from each other on the floor of the pool such that regions A and C are separated by about two feet. The water flow through the device 10 into the drain 30 is indicated by arrows in FIG. 4. The openings 26 on the central portion 12 may extend in a direction parallel or at right angles to the direction of the openings 22, 24 on the channel portions 14, 16. In addition, side walls 13 of the central portion 12 may be cut away as desired to accommodate a higher flow rate to the drain. The top wall of the central portion 12 may be convex, as shown more clearly in FIG. 1, or it may be substantially flat and even with the top walls 32, 34 of the members 14, 16 at each side of the central portion 12.

The central portion 12 preferably is circular in cross-section or top plan view to correspond to the cylindrical inlet 28 of the drain 30, although, other shapes may be used. Similarly, the channel portions 14, 16 adjacent the central portion 12 may have other geometric shapes for aesthetic appeal or to accommodate a unique pool or spa shape.

The channel portions 14, 16 are preferably substantially identical, and in a preferred embodiment extend about 14 inches away from the central portion 12 and are about 5 inches wide. The top walls 32, 34 of the channel portions 14, 16 are spaced about 1½ inches above the pool floor 18. Preferably, each channel portion 14, 16 has a pair of side walls 36, 38 extending downwardly to the pool floor 18. Each side wall has a series of four slots 40, 42 each about 3 inches long and ¼ inch wide and extending substantially the length of the respective channel portion 14, 16. The openings 22, 24 at the distal end of each channel portion 14, 16 extend parallel to the length of the channel portion and are about 6 inches long and ½ inch wide. The side walls 36, 38 of the members may be formed without slots in alternative embodiments. Also, the distal end walls 44, 46 of the members 14, 16 may be open as shown, or closed or slotted.

The embodiments described above are provided merely to illustrate the present invention. Changes and modifications may be made from the embodiments presented herein by those skilled in the art without departure from the spirit and scope of the invention, as defined by the appended claims.

What is claimed is:

1. A safety device for a drain on a floor of a pool or spa, comprising:

an elongate flow passage structure adapted to overlie said floor drain and extend outwardly from said drain on at least one side of said drain, said flow passage structure having at least two openings spaced from each other by a predetermined distance and comprising an elongate channel portion configured to conduct fluid in a direction toward said drain, said elongate channel portion comprising walls which extend along said direction so as to form an elongate substantially enclosed flow path, said elongate flow passage structure being configured to provide fluid communication between each of said openings and said drain to allow water from said pool or spa to be drawn through each of said openings into said drain by suction, said predetermined distance being at least about a foot and a half to effectively inhibit a human body from blocking all of said openings at the same time, whereby one of said openings has substantially unrestricted fluid communication with said drain.

2. The device of claim 1, wherein one of said openings is positioned proximate to an end of said channel portion distal from said drain.

3. The device of claim 2, wherein said walls of said channel portion form a U-shaped cross section.

4. The device of claim 2, wherein said structure comprises a second channel portion extending outwardly from said drain in a direction opposite that of said first channel portion.

5. The device of claim 4, wherein walls of said first and second portions are slotted.

6. The device of claim 4, wherein said structure comprises a central portion which overlies said drain and interconnects said first and second channel portions.

7. The device of claim 6, wherein said central portion has an opening in fluid communication with the drain.

8. The device of claim 6, wherein said central, first and second portions are integrally formed.

9. The device of claim 1, wherein said predetermined distance is at least about two feet.

10. A safety device for a drain on a floor of a pool or spa, comprising an elongate flow passage structure adapted to overlie said floor drain and extending outwardly from said drain a significant distance from a side of said drain to form a fluid flow path, said elongate flow passage structure formed by at least first and second walls that intersect along at least a substantial portion of the fluid flow path, at least one of said first and second elongate intersecting walls having a water flow opening proximate a distal end of the flow passage structure to permit water to flow into said flow passage structure and along the fluid flow path and to said floor drain.

11. The safety device of claim 10, wherein said distance is about fourteen inches.

* * * * *